US005971832A

United States Patent [19]

Siboni

[11] Patent Number: 5,971,832

[45] Date of Patent: Oct. 26, 1999

[54] SKATE TOY

[76] Inventor: Eytan Siboni, 61-22 172nd St., Fresh Meadow, N.Y. 11365

[21] Appl. No.: 08/934,726

[22] Filed: Sep. 29, 1997

Related U.S. Application Data

[63] Continuation of application No. 08/683,811, Jul. 16, 1996, abandoned.

[51] Int. Cl.[6] ..... A63H 3/50

[52] U.S. Cl. ..... 446/279; 446/291; 446/269; 446/289; 446/290

[58] Field of Search ..... 446/269, 270, 446/279, 280, 285, 288–294

[56] References Cited

U.S. PATENT DOCUMENTS

| | | | |
|---|---|---|---|
| D. 179,949 | 3/1957 | Malsed | 446/291 X |
| 596,109 | 12/1897 | Gedney | 446/291 X |
| 1,150,440 | 8/1915 | Logan | 446/28 |
| 1,544,555 | 7/1925 | Chase | 446/279 |
| 1,586,146 | 5/1926 | Fiore | 446/269 |
| 2,566,141 | 8/1951 | Poli | 446/268 |
| 2,820,324 | 1/1958 | Echelmeiser | 446/279 |
| 2,839,302 | 6/1958 | Almoslino | 446/279 |
| 3,465,473 | 9/1969 | Nakamura | 446/269 |
| 4,095,367 | 6/1978 | Ogawa | 446/288 X |
| 4,355,482 | 10/1982 | Sapkus et al. | 446/279 |
| 4,708,688 | 11/1987 | Lee | 446/288 |
| 4,846,752 | 7/1989 | Combs | 446/279 |

FOREIGN PATENT DOCUMENTS

| | | | |
|---|---|---|---|
| 145414 | 2/1952 | Australia | 446/288 |
| 428317 | 4/1911 | France | 446/279 |
| 41970 | 4/1910 | Germany | 446/279 |
| 92/21416 | 12/1992 | WIPO | 446/280 |

*Primary Examiner*—Robert A. Hafer
*Assistant Examiner*—Michael B. Priddy
*Attorney, Agent, or Firm*—Schweitzer Cornman Gross & Bondell LLP

[57] ABSTRACT

A toy having a toy body, and a roller skating accessory integral with a part of the body, with a rigid or a freely rotating wheel.

4 Claims, 1 Drawing Sheet

SKATE TOY

The present application is a continuation of application U.S. patent application Ser. No. 08/683,811 filed Jul. 16, 1996, now abandoned

FIELD OF THE INVENTION

The present invention relates to a skate toy that is similar to that described in application for U.S. patent Ser. No. 08/582,454 filed on Jan. 3, 1996 abandoned.

BACKGROUND OF THE INVENTION

The aforesaid earlier patent application relates to a novel roller skating accessory to be used by a wearer of in-line roller skates. The disclosure of that application is incorporated herein for purposes of explanation, by reference thereto.

The accessory of the aforesaid patent application is essentially a wheel or a set of wheels which can be attached to various parts of the body of the skater wearing an in-line skate, to enable heretofore impossible ways of roller skating, and to provide additional rolling surfaces on the body of the wearer for increased safety. Thus the accessory of the earlier invention can be worn on any part of the body, such as the knee, lower arm, palms, helmet, etc. The accessory can also be attached to the paws of a skating animal such as for towing or accompaniment by a skaters The wheeled skating accessory can also be attached to the body of a toy skater, but the aforesaid patent application, however does not feature all ways and forms of making toys with such roller skating accessories.

SUMMARY OF THE INVENTION

It is an object of the present invention to extend to the invention of the aforesaid patent application to broader aspects of toys, such as human and animal toy figures. Accordingly, the present invention comprises a toy figure, having at least one roller skating accessory integral with the body of the toy figure, such as in the case of molded toy figures the accessory being integrally molded therewith.

As used throughout the specification and the claims, "toy" refers to a doll having the shape of a human, or an animal, or of any other fanciful toy shape, form or body which can be adapted for in-line roller skating and/or wear an accessory therefor. As used throughout the specification and the claims, "skating accessory"means in addition to an in-line roller skate integrally attached to the foot of the doll, at least one additional wheel attached to the body of the doll other than to its feet, wherein the wheel is a functional or nonfunctional, omnidirectional or unidirectional wheel.

Figure 1:
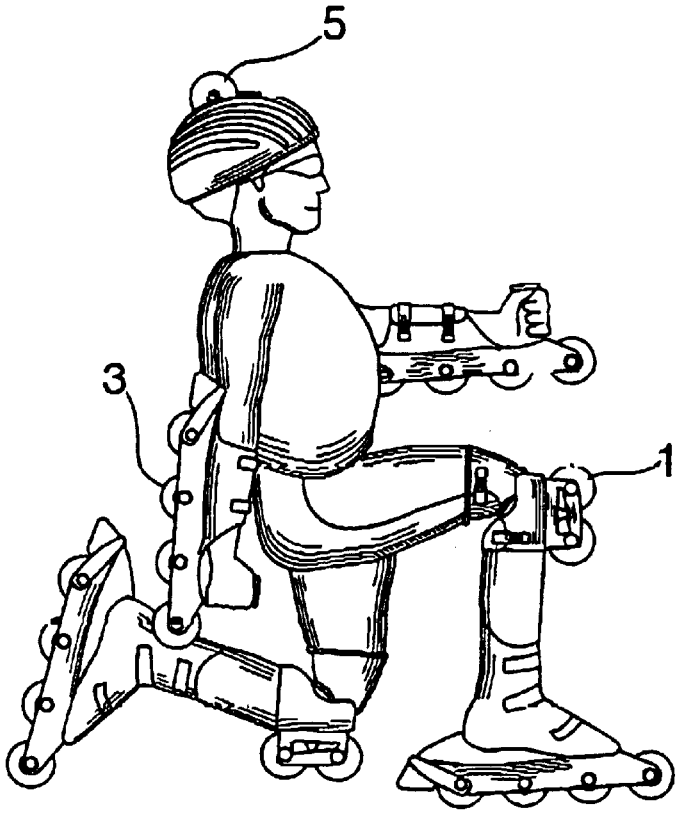
Figure 2:
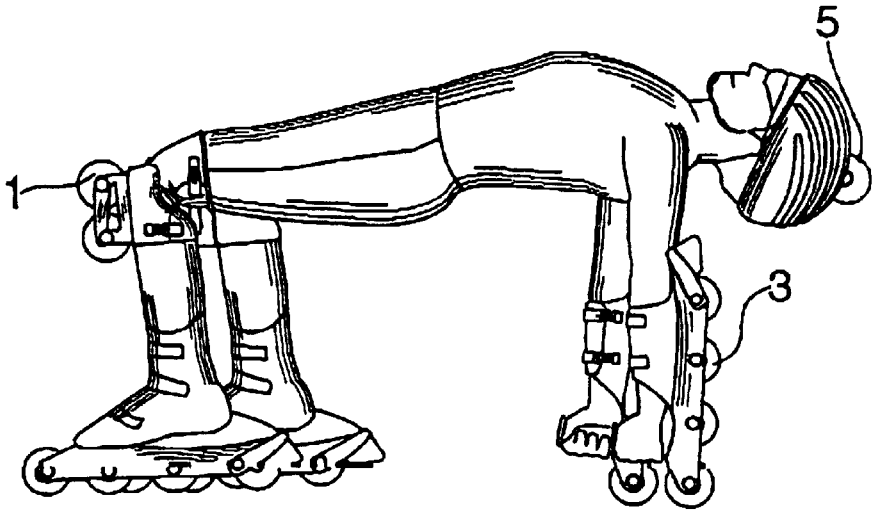

The invention is further described with reference to the accompanying drawing, wherein FIG. 1 shows a kneeling skater toy in accordance with the invention; and FIG. 2 shows a skating toy of the invention in the so called bridge gymnastic position.

DETAILED DISCLOSURE

Whereas the aforesaid patent application covers in-line rolling skating accessories regardless of their size and the nature of the body to which it is to be attached, the present invention relates to an entire toy figure with one or more roller skating accessories forming an integral, permanent part of the toy figure: Thus, for example, a knee roller accessory 1 is suitably a permanently formed, integral part of the knee of the toy figure. The in-line wheel of the knee accessory 1 can be a firmly molded rigid wheel imitation or "dummy" or a freely revolving, miniature wheel.

In a similar manner an in-line roller skating arm accessory 3, and a roller helmet accessory 5 are respectively attached to the arm, and head with helmet of the toy figure, with firmly molded and/or rotatably attached wheel or wheels.

In the manner described, the toy body of the present invention can have any number and any variety of in-line roller skating accessories integrally molded with parts of the molded toy body.

Accordingly, the present invention encompasses any kind of toy figure which has one or a plurality of integral roller skating accessories with or without functional wheels, whether unidirectional or omnidirectional, incorporated in such roller skating accessory or accessories.

I claim:

1. A toy body in the shape of a human said wheels adapted to contact a planar surface, for positioning it in various acrobatic skating postures, the toy body having feet with soles thereon, a pair of in-line roller skates integral with or attached to the soles of the feet and having wheels thereon at least one of said body parts other than said feet, for said accessory contacting said surface simultaneously with said roller skates, the toy body comprising an accessory attached to or integral with at least one of said body parts other than said feet, for said accessory contacting said surface simultaneously with said roller skates, said accessory comprising one or more wheels for supporting the toy body on a surface for assuming diverse acrobatic skating postures.

2. The toy body of claim 1, wherein said accessory has one or more rollable wheels, and said rollable wheel is one or more (a) unidirectional wheel, or (b) omnidirectional wheel.

3. The toy body of claim 1, wherein the toy body is in the shape of a human body having a head, arms each with an elbow, lower arm, and a hand, torso, and legs each with a knee, and said body part having said accessory attached to its outer surface, is one or more of the head, torso, one or both arms, one or both elbows, one or both lower arms, one or both legs, and one or both knees.

4. The toy body of claim 1, wherein the toy body is in the shape of a human body having a head with an integral or detachable helmet thereon, and said accessory is attached to or integral with said helmet.

* * * * *